US009334025B2

(12) United States Patent
Barreira

(10) Patent No.: US 9,334,025 B2
(45) Date of Patent: May 10, 2016

(54) MULTI-COLUMN BUOY FOR DEEP AND ULTRA-DEEP WATER TRANSPORTATION TERMINALS

(75) Inventor: Rodrigo Augusto Barreira, Duque de Caxias (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 77 days.

(21) Appl. No.: 14/116,918

(22) PCT Filed: May 12, 2011

(86) PCT No.: PCT/BR2011/000133

§ 371 (c)(1),
(2), (4) Date: Feb. 26, 2014

(87) PCT Pub. No.: WO2012/151644

PCT Pub. Date: Nov. 15, 2012

(65) Prior Publication Data

US 2014/0187109 A1 Jul. 3, 2014

(51) Int. Cl.
*B63B 35/44* (2006.01)
*B63B 22/02* (2006.01)

(52) U.S. Cl.
CPC ..... *B63B 22/021* (2013.01)

(58) Field of Classification Search
CPC ..... B63B 35/4413; B63B 22/021
USPC ..... 114/265
See application file for complete search history.

(56) References Cited

U.S. PATENT DOCUMENTS

| | | | | | |
|---|---|---|---|---|---|
| 3,111,692 | A | * | 11/1963 | Cox | 114/264 |
| 3,154,039 | A | * | 10/1964 | Knapp | 114/265 |
| 3,885,511 | A | * | 5/1975 | Wipkink et al. | 114/265 |
| 4,169,424 | A | * | 10/1979 | Newby et al. | 114/265 |
| 4,254,522 | A | | 3/1981 | Van Heijst | |
| 4,449,946 | A | | 5/1984 | Versluis et al. | |
| 2010/0111614 | A1 | | 5/2010 | Thomas | |

FOREIGN PATENT DOCUMENTS

| | | | |
|---|---|---|---|
| GB | 2 292 360 | A | 2/1996 |
| GB | 2 350 342 | A | 11/2000 |
| JP | 2004-191268 | A | 7/2004 |

OTHER PUBLICATIONS

C. Blanc, et al., "Deepwater Oil Export Systems: Past, Present, and Future", Offshore Technology Conference 18085, May 1-4, 2006, pp. 1-12.

P. Jean, et al., "Failure of Chains by Bending on Deepwater Mooring Systems", Offshore Technology Conference 17238, May 2-5, 2005, pp. 1-12.

(Continued)

*Primary Examiner* — Stephen Avila
(74) *Attorney, Agent, or Firm* — Sughrue Mion, PLLC

(57) ABSTRACT

The present invention relates to a floating coastal structure used in water transportation terminals for production flowage of the petroleum industry. The structure exhibits a constructive configuration comprised of multiple monobuoys interconnected in an arrangement and in a specific dimensional relationship, being capable of reducing the instability and movements generated by the hydrodynamic effect of waves, thereby reducing the stresses of the accessory components, such as mooring lines, oil transfer lines and discharge hoses, connected to it.

7 Claims, 3 Drawing Sheets

(56) References Cited

OTHER PUBLICATIONS

S. Montbarbon, et al., "Experience with New Cost-Effective Solutions to Export Oil from Deepwater Floating Production Units Using Suspended Pipelines", Offshore Technology Conference 17318, May 2-5, 2005, pp. 1-7.

N.C.Nolop, et al., "Erha and Erha North Development: Steel Catenary Risers and Offloading System", Offshore Technology Conference 18657, Apr. 30-May 3, 2007, pp. 1-9.

IR. J.L. Cozijn, et al., "Coupled Mooring Analysis for a Deep Water Calm Buoy", Proceedings of OMAE 2004, Jun. 20-25, 2004, pp. 1-11, Vancouver Canda.

C. Bauduin, et al., "ERHA Deep Water System—Couple Analysis and Model Tests Calibration", DOT, 2004.

* cited by examiner

MULTI-COLUMN BUOY FOR DEEP AND ULTRA-DEEP WATER TRANSPORTATION TERMINALS

FIELD OF THE INVENTION

The present invention relates to a floating coastal structure used in water transportation terminals for production flowage of the petroleum industry.

The structure exhibits a constructive configuration differentiated from the traditional one, capable of reducing the instability and movements generated by the hydrodynamic effect of the waves, thereby reducing the stresses of accessory components, such as mooring lines, oil transfer lines and discharge hoses connected to it.

THE BASIS OF THE INVENTION

The deep water oil industry requires the use of stationary production units (SPU) [unidades estacionárias de produção (UEP)], which once anchored to the seabed, operate as an oil and gas well production and/or exploration unit.

Due to the increased depth of the water depth and consequently the safety requirements for these SPU's to operate in these areas, seeking technical solutions to meet the challenges inherent in the wave, wind and current environmental conditions typical of the open sea is becoming increasingly more complex.

One of the main challenges in this environment is to safely conduct the operation of transferring oil from the SPU to production transport ships, known in technical terms as "tankers."

There are currently two basic methods of performing this transfer: directly between the shuttle tanker and the SPU, or through a coastal water transportation terminal.

In the scenario of the Santos Basin [Bacia de Santos] (Brazil) in the Pre-Salt region, where new SPU's are anchored, sea conditions are usually harsh and direct transfer, aside from requiring special shuttle tankers fitted with a dynamic positioning system, presents many risks of accidents, from the risk of rupture of floating hoses, to collisions between vessels, which not only entails heavy material losses, but also entails immense environmental damage.

The second method of transferring the production is using a coastal water transportation terminal between the two vessels, basically represented by a large monobuoy [or single point mooring] serving as an intermediate connection station between the shuttle tanker and the SPU. Thus, the shuttle tanker can remain at a safe distance from the SPU if there should be a failure in the positional stability control of one of the vessels.

However, this concept of oil flowage through monobuoys is already widely used in water transportation terminals in shallow waters close to shore, where environmental conditions are generally mild as it concerns sheltered waters. In these cases small displacement conventional cylindrical monobuoys, that is, diameter <12 m and draft <5 m are used as water transportation terminals.

The industry as a whole has gained significant experience from these transfer systems in shallow waters installed in moderate environmental conditions, such as those on the west coast of Africa. However, projects for ultra-deep regions and more severe environmental conditions, such as the coast of Brazil in the Santos Basin still represents a challenge, particularly with regard to oil transfer line fatigue, specifically in connection areas.

RELATED TECHNIQUE

We can cite some technologies being researched and developed by various companies in the industry, such as SBM, APL, BlueWater and Modec.

SBM developed the TSALM (Tendon Single Anchor Leg Mooring) and DDCALM (Deep Draft CALM) both inspired by the SPAR concept. However, we already know that in these technologies the connections of the mooring and oil transfer lines are below the waterline, and any procedure performed on them requires complex operations with divers or remotely operated robots.

Works have also been presented in congresses that discuss current issues and research on the subject:

[1] C. Blanc, J.-L. Isnard, R. Smith, 2006. "Deepwater Oil Export Systems: Past, Present, and Future." OTC 18085.

[2] P. Jean, K. Goessens, D. L'Hostis, 2005. "Failure of Chains by Bending on Deepwater Mooring Systems." OTC 17238.

[3] S. Montbarbon, S. H. Quintin, G. Deroux, 2005. "Experience With New Cost-Effective Solutions to Export Oil From Deepwater Floating Production Units Using Suspended Pipelines." OTC 17318.

[4] N. C. Nolop, H. H. Wang, W. C. Kan, J. B. Sutherland, E. S. Elholm, D. S. Hoyt, S. Montbarbon, H. Quintin, 2007. "Erha and Erha North Development: Steel Catenary Risers and Offloading System." OTC 18657.

[5] J. L. Cozijn, T. H. J. Bunnik, 2004, "Coupled Mooring Analysis for a Deep Water CALM Buoy." OMAE 2004.

[6] C. Bauduin, C. Blanc, E. S. Elholm, G. de Roux, M. J. SAntala, 2004. "ERHA Deep Water Export System—Couple Analysis and Model Tests Calibration." DOT 2004.

The objective of this research is, regardless of sea conditions, to reduce the stresses between the three basic components comprising the flowage system of a coastal water transportation terminal: the oil transfer line, the monobuoy mooring system and the monobuoy hull.

Accordingly, an effort has been made to reduce, as far as possible, the displacements of the water transportation terminal, represented by the monobuoy, to six possible degrees of freedom, that is, three planar degrees of freedom and three angular degrees of freedom. The three planar degrees of freedom xyz correspond, respectively, to the surge (heave), drift (sway) and sinking (heave) movements, and the three angular degrees of freedom correspond to the rolling (roll), pitching (pitch) and yawing (yaw) movements.

The vertical displacement in the z direction is caused, among other factors, by the sea waves that, upon passing through the hull of the monobuoy, make it go up and the waves down, due to hydrostatic hydrodynamic effect at its bases. In this type of displacement, the positioning of the water transportation terminal can vary as much as 10 meters in relation to the mean sea surface depending on the ambient condition. Due to its shape, angular displacement may then occur likewise in any direction.

These various movements cause operating difficulties, from problems with the oil transfer lines and their connections even to fatigue of the mooring lines, which eventually break.

Currently, several oil flowage systems are being (or have already been) installed in deep waters off the west coast of Africa. The technology of all these flowage systems are based on the traditional concept of a large displacement cylindrical monobuoy, that is, with a diameter >23 m, coupled to an SPU by two or more midwater oil transfer lines.

Among the systems on the coast of Africa, there are differences in the arrangement and composition of mooring lines as well as in the diameter, configuration and material of the oil transfer line.

Viewed from afar, deep water monobuoys are quite similar to the popular shallow water monobuoy. In fact the first deep water monobuoys were an extrapolation of shallow water monobuoys, but with very different design assumptions, specific to each environmental setting.

In more severe environmental conditions, such as those in the Brazilian coast in the Santos Basin, the wave periods of which vary from 5 to 20 seconds and can reach a maximum height of 18 meters, the conventional cylindrical monobuoys of the African coast exhibit pronounced vertical and rotational movements inherent the hydrodynamics of their geometry, imposing severe stresses both in the mooring lines and on the oil transfer lines.

One of the possible solutions for the water transportation terminals in the in Santos Basin, and already used on the west coast of Africa, is increasing the diameter of the mooring lines in the critical area; however, this generates greater vertical load on the system. As for the transfer line, reducing its diameter could be a solution; however, this entails a consequent decrease in the transfer rate of oil from the SPU to the shuttle tanker. In some cases this solution can make the entire field project unviable.

Thus, this invention seeks to overcome these problems by creating a technically and economically viable solution that does not alter the production transfer rate.

As a result of this research, a multi-column buoy for marine transportation terminals in deep and ultra-deep waters was devised.

The concern in developing this new equipment was to achieve minimal, primarily vertical and rotational movement of the water transportation terminal, while reducing as much as possible the resultant stresses on the connections of the mooring and transfer lines.

The invention described below derives from continuous research tracking the transfer of production, the objective focus of which was to significantly increase the production transfer rate in safe operating conditions.

Other objectives that the multi-column buoy for transportation terminals in deep and ultra-deep waters aim to achieve are listed below:

1. Lower the costs of construction and installation;
2. Provide greater operating safety;
3. Ensure a more stable structure, regardless of the sea conditions;
4. Reduce the production transfer time;
5. Reduce the need for periodic inspections of accessories, such as mooring lines and connections;
6. Prevent environmental disasters.

SUMMARY OF THE INVENTION

The present invention relates to a multi-column buoy for transportation terminals in deep and ultra-deep water.

The invention basically comprises a set of monobuoys arranged equidistantly from a common center to them, and interconnected by a lattice upper structure. Each monobuoy exhibits a typical, predominantly cylindrical configuration.

The lattice structure comprises as many center beams as the number of monobuoys used, wherein each center beam meets in the center of the structure and connects the center of said lattice structure to the attachment point of the respective monobuoy. The lattice structure is laid out on the monobuoys, where each of the monobuoys is attached to the end of its respective center beam. Peripheral beams interconnect the free ends of the center beams so as to close the lattice structure.

The center of the lattice structure is equipped with a swivel joint where the oil transfer line is connected.

BRIEF DESCRIPTION OF THE DRAWINGS

The invention will be described in more detail below in conjunction with the drawings listed below, which accompany this report, as an integral part thereof, and in which.

DETAILED DESCRIPTION OF THE INVENTION

Figure 1:
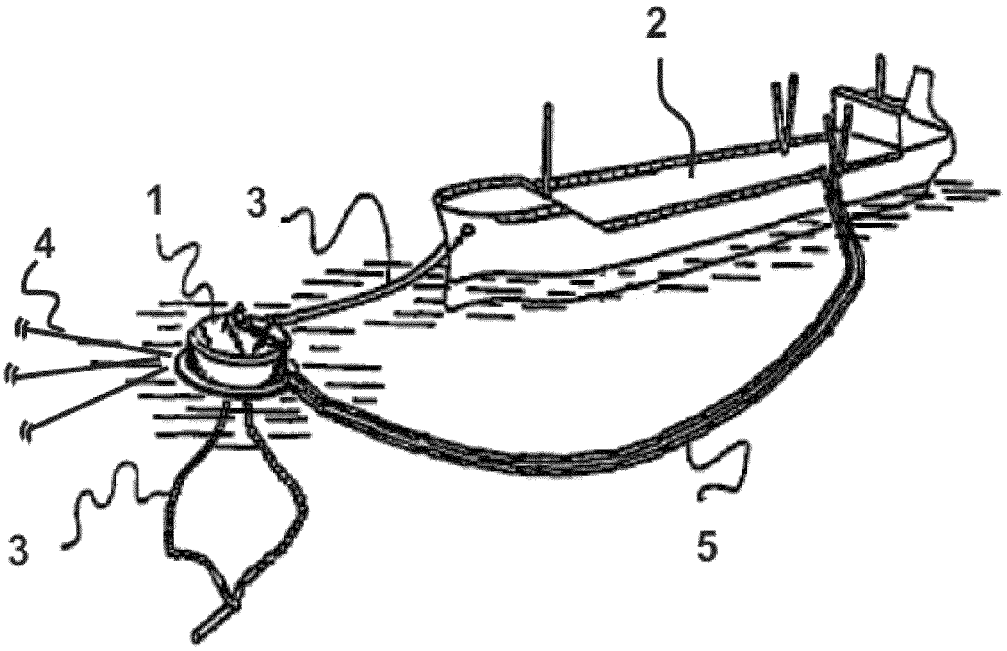
FIG. 1 depicts a typical water transportation terminal of the prior technique.

FIG. 1 shows a water transportation terminal (1) typical of the prior technique with an anchored shuttle tanker (2), and their respective connections between the mooring lines (3), oil transfer lines (4) and floating hose (5). The standard configuration in the form of a cylindrical monobuoy is apparent. For shallow water, diameters <12 meters and a draft <5 meters usually apply, whereas for deep water the diameters are commonly >23 meters.

Figure 2:
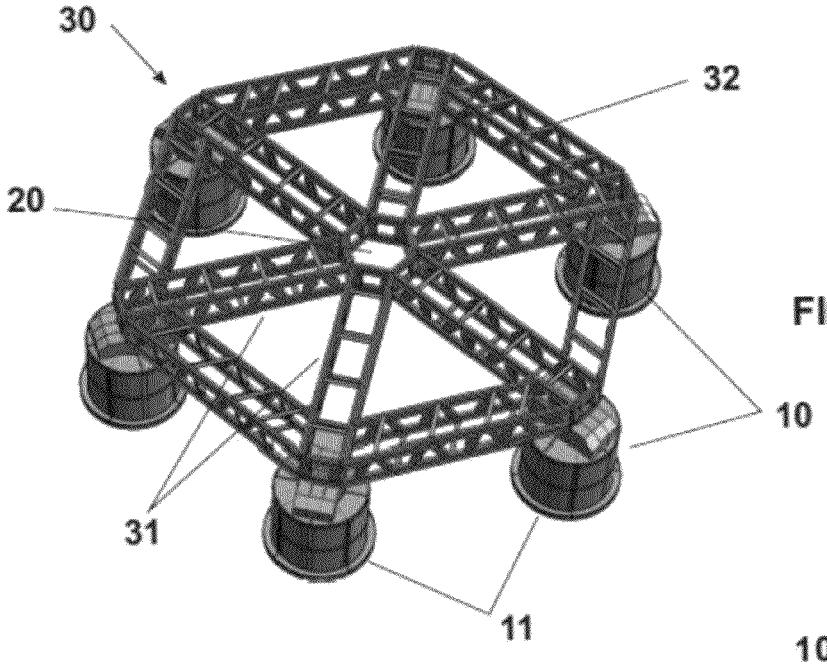
FIG. 2 depicts a perspective view of the proposed water transportation terminal.

FIG. 2 shows a perspective view of a multi-column buoy (100) for transportation terminals in deep and ultra-deep water, which is the object of the invention. Said buoy was developed from research aimed at improving the control, not only the damping of water transportation terminals, but primarily the fatigue stresses imposed on the connections to the mooring and transfer lines.

Figure 3:
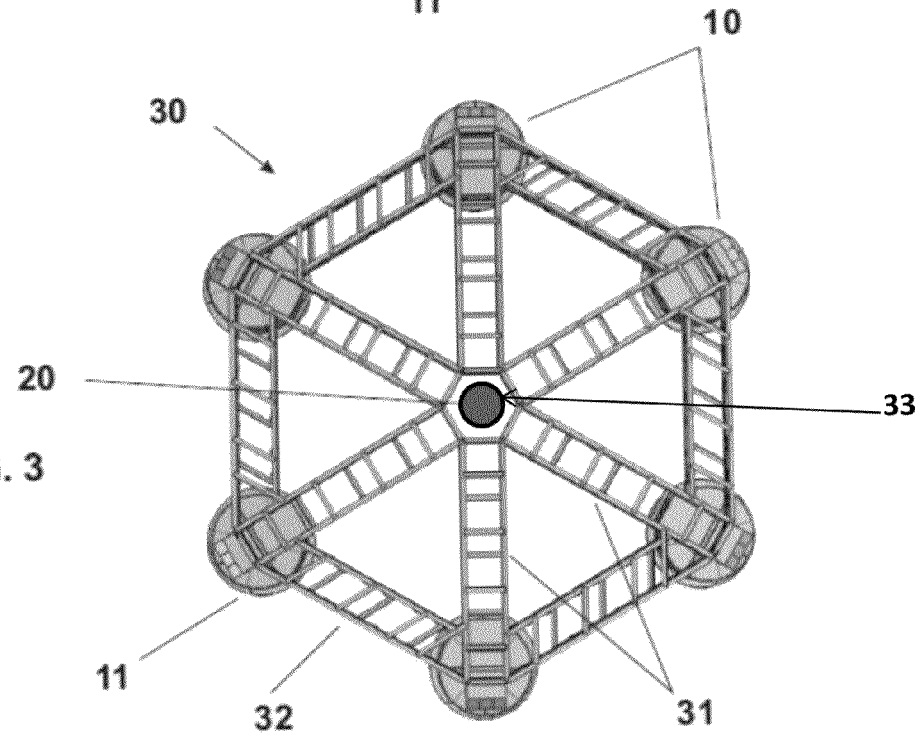
FIG. 3 depicts a top view of the proposed water transportation terminal of the invention.
Figure 4:
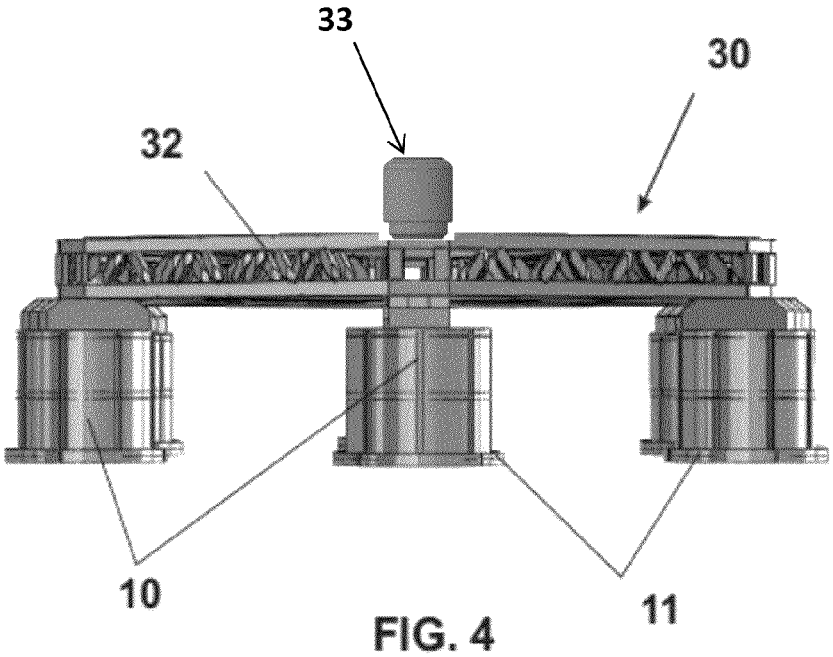
FIG. 4 depicts a side view of the water transportation terminal of the invention.

Observing FIGS. 2, 3 and 4 together, it is possible to understand the entire operating principle of the current invention. The multi-column monobuoy (100) comprises a set of monobuoys (10) laid out equidistantly from a center (20) common to them and interconnected by means of a lattice top structure (30).

At least three monobuoys (10) of the same size, but preferably six monobuoys, are necessary and capable of providing the ideal conditions for stabilization. In this preferred configuration the monobuoys (10) are arranged at an angular distance of 60° and a fixed radial distance from center (20) of the lattice structure (30), thereby forming a predominantly circular configuration.

Each monobuoy (10) exhibits a typical, predominantly cylindrical, configuration and can exhibit a stabilization skirt (11) in the lower section of its hulls, thus optimizing the overall damping of the movements of the multi-column buoy (100). The skirts (11) are in turn equipped with points for fixing the mooring lines to the multi-column buoy (100) (not shown in the figure).

The lattice structure (30) comprises as many center beams (31) as the number of monobuoys (10) used, wherein each center beam (31) joins the center (20) of said lattice structure to the attachment point of the respective monobuoy (10).

Peripheral beams (32) interconnect the free ends of the center beams (31) so as to close the lattice structure (30), reinforcing it.

The lattice structure (30) is laid out on monobuoys (10), wherein each one of monobuoys can be attached directly to the free end of its corresponding center beam (31), or optionally a ball joint can be used as coupling. This option optimizes the overall damping of the movements of the multi-column buoy (100) against sea waves.

The center (20) of the lattice structure (30) is equipped with a swivel joint (33) to where the oil transfer line is connected.

It should be emphasized that the proposed new hull geometry allows the oil transfer line (5) to be installed securely and dry near the center of gravity of the structure. The constructive configuration reduces the stresses transferred by the rotational movements of the hull to the connection due to waves, significantly increasing its lifespan with respect to fatigue.

In the water transportation terminals of the prior technique, a stress arm formed, caused by the distance between the attachment point of the transfer line (5) generally at the base of the hull, and the center of gravity of the structure, contributing to increased stresses, primarily in the connection area.

The size of the components in relation to anticipated waves and currents in the installation area is as important as the constructive configuration of multi-column buoy (100). Thus, the components of multi-column buoy (100) should preferably satisfy the following conditions:

$$0.15<Dcil/Dt<0.5 \text{ and } 0.30<Dcil/T<2$$

Where:

Dcil=diameter of each monobuoy (10),

Dt=diameter of the circumference containing the outer edge of monobuoys (10), and T=size of the draft of each monobuoy (10).

Tests were conducted in sea conditions comparable to the extreme conditions of the Santos Basin, namely a 100-year wave with a Tp (peak period) of 15.5 seconds and Hs (significant wave height) of 11.1 meters (maximum height of approximately 18 meters). Multi-column buoy (100) using the proposed dimensional relationship exhibited only 9.12 degrees of maximum amplitude for the angular motion (pitch). A conventional monobuoy exhibits approximately 30 degrees of maximum amplitude for this same sea condition.

For the limiting operating condition for connection of a shuttle tanker connected to water transportation terminals with Hs 3.5 meters, and adopting a Tp of 10.5 seconds, the multi-column buoy (100) exhibits only 5 degrees of maximum amplitude for the angular motion (pitch).

It should be noted that another major advantage in using this preferred configuration is the ability to work in extreme sea conditions without operating risks, keeping the connection of the oil transfer lines constantly out of the water.

Thus, the water transportation terminal, formerly a simple monobuoy, is now a structure capable of providing means of floatation control directly affecting the durability of the oil transfer lines, and consequently environmental safety, since it minimizes the extreme stresses on the connection points.

The invention was described herein with reference being made to the preferred embodiments thereof. It should, however, be clarified that the invention is not limited to these embodiments, and those skilled in the technique will readily understand that modifications and substitutions can be made within the inventive concept described herein.

The invention claimed is:

1. A multi-column buoy for transportation terminals in deep and ultra-deep waters, comprising:

a set of a plurality of monobuoys, each of the plurality of monobuoys having a cylindrical shape, each of the plurality of monobuoys arranged equidistantly from a center common to the plurality of monobuoys, a center of gravity provided at the center common to the plurality of monobuoys;

an upper lattice structure comprising a plurality of center beams, a number of the plurality of center beams matching a number of the plurality of monobuoys and interconnecting the plurality of monobuoys, wherein each center beam of the plurality of center beams connects the center of said lattice structure to a point of attachment of a respective monobuoy;

a plurality of peripheral beams interconnecting free ends of the plurality of center beams so as to close the lattice structure, the lattice structure laid out on the plurality of monobuoys; and a swivel joint provided along a center axis of the lattice structure, where an oil transfer line is connected to the swivel joint.

2. The multi-column buoy for transportation terminals in deep and ultra-deep waters according to claim 1, wherein the multi-column buoy meets the following conditions: $0.15 \leq Dcil/Dt \leq 0.5$ and $0.30 \leq Dcil/T \leq 2$, where Dcil is a diameter of each monobuoy, Dt is a diameter of a circumference containing an outer edge of monobuoy and T is a dimension of a draft of each monobuoy.

3. The multi-column buoy for transportation terminals in deep and ultra-deep waters according to claim 1, wherein the plurality of monobuoys comprises six monobuoys, wherein the six monobuoys are configured to provide ideal conditions for stabilization, and wherein the six monobuoys are arranged at an angular distance of 60° and at a fixed radial distance in relation to the center of the lattice structure forming a circular configuration.

4. The multi-column buoy for transportation terminals in deep and ultra-deep waters according to claim 1, wherein each monobuoy comprises a stabilization skirt in a lower section of a hull of the monobuoy.

5. The multi-column buoy for transportation terminals in deep and ultra-deep waters according to claim 1, wherein a stabilization skirt comprises a point for attaching a mooring line.

6. The multi-column buoy for transportation terminals in deep and ultra-deep waters according to claim 1, wherein weight stresses relating to the oil transfer lines are concentrated at the center of gravity of the multi-column buoy.

7. A multi-column buoy for transportation terminals in deep and ultra-deep waters, comprising:

a set of a plurality of monobuoys, each of the plurality of monobuoys having a cylindrical shape, each of the plurality of monobuoys arranged equidistantly from a center common to the plurality of monobuoys, a center of gravity provided at the center common to the plurality of monobuoys;

an upper lattice structure comprising a plurality of center beams, a number of the plurality of center beams matching a number of the plurality of monobuoys and interconnecting the plurality of monobuoys, wherein each center beam of the plurality of center beams connects the center of said lattice structure to a point of attachment of a respective monobuoy;

a plurality of peripheral beams interconnecting free ends of the plurality of center beams so as to close the lattice structure, the lattice structure laid out on the plurality of monobuoys; and a swivel joint provided in the center of the lattice structure, where an oil transfer line is connected to the swivel joint, wherein each monobuoy is attached directly to the free end of the respective center beams by a ball joint.

* * * * *